United States Patent [19]

Fujiki et al.

[11] Patent Number: 4,933,008

[45] Date of Patent: Jun. 12, 1990

[54] HEAT RESISTANT AND WEAR RESISTANT IRON-BASED SINTERED ALLOY

[75] Inventors: Akira Fujiki; Yoshiteru Yasuda, both of Yokosuka; Makoto Abe, Zushi, all of Japan

[73] Assignee: Nissan Motor Co., Ltd., Yokohama, Japan

[21] Appl. No.: 305,910

[22] Filed: Feb. 3, 1989

[30] Foreign Application Priority Data

Feb. 5, 1988 [JP] Japan ..... 63-23884

[51] Int. Cl.[5] ..... C22C 29/14

[52] U.S. Cl. ..... 75/244; 75/246; 419/38; 123/188 S

[58] Field of Search ..... 75/246, 244; 123/188 S; 419/38

[56] References Cited

U.S. PATENT DOCUMENTS 4,093,454 6/1978 Saito et al. ..... 75/236

4,422,815 12/1983 Nakata et al. ..... 75/243

*Primary Examiner*—Brooks H. Hunt

*Assistant Examiner*—Ngroclan Mai

*Attorney, Agent, or Firm*—Foley & Lardner, Schwartz, Jeffery, Schwaab, Mack, Blumenthal & Evans

[57] ABSTRACT

A heat resistant and wear resistant iron-based sintered alloy for use as the material of an engine component part which is subjected to severe temperature and wear conditions. The iron-based sintered alloy is comprised of a matrix formed of metal powder having the composition of alloy steel or high speed tool steel. An additional metal component formed of hard alloy powder is dispersed in the matrix in an amount ranging from 3 to 50% by weight of the matrix. The hard alloy powder contains as major components iron, molybdenum and silicon which improve the wetting property of the hard alloy powder with the matrix and form intermetallic compounds which are high in hardness and excellent in heat and oxidation resistances.

19 Claims, No Drawings

HEAT RESISTANT AND WEAR RESISTANT IRON-BASED SINTERED ALLOY

BACKGROUND OF THE INVENTION

1. Field of the Invention

This invention relates in general to a heat resistant and wear resistant iron-based sintered alloy as the material of a component part which requires heat resistance, wear resistance and corrosion resistance while exhibiting low attacking ability against and high concordance with an opposite contactable member, and more particularly to a material suitable for a valve seat, a valve face and a waste gate valve of a turbocharger for an internal combustion engine.

2. Description of the Prior Art

In recent years, wear of component parts of an engine valve system for an internal combustion engine has become an issue with requirement of increasing engine speed and engine power output, in which particularly valve seats require excellent oxidation resistance, friction characteristics and durability at high temperatures under severe high temperature engine combustion conditions. In this connection, a turbocharger is also required to be formed of a material durable in oxidation and friction at high temperatures.

Thus, since such component parts of the engine are subjected not only to high temperatures but also to friction and hammering, they are required to be formed of a material having high heat resistance, wear resistance and pitting resistance together with concordance with the material of an opposite contactable member. Materials which have been hitherto proposed and put into practical use as the above-mentioned material are heat resistant steel, other heat resistant materials of the crystallized and hardened type, cermets containing ceramic particles, alloys of the dispersion strengthened type, and the like. Additionally, as the material of a valve seat, a sintered material containing molybdenum (Mo) has been proposed, using self-lubrication effect due to higher hardness at high temperatures and oxide film which are resulted from Mo which is not diffused. In this connection, the material of the type wherein Mo is dispersed in iron (Fe) is disclosed, for example, in Japanese Patent Provisional Publication No. 58-71355. Furthermore, alloys in which metal-carbide and/or metal-silicide is crystallized on the surface thereof have been proposed.

However, such conventional heat resistant materials are lower in high temperature hardness and wear resistance. More specifically, the material containing ceramic particles tend to cause abnormal wear owing to lower bonding force between the particle and the matrix, while damaging the opposite contactable member. Fe—Mo compound powder and Mo powder are low in compactibility and in wetting property with the matrix. Accordingly, the material containing these powders tends to break while causing the powder to remove therefrom, thereby attacking the opposite contactable member. Moreover, the carbide and the silicide allow the material containing them to be lowered in oxidation resistance at high temperatures. Thus, the above-discussed conventional materials are not sufficient in a required performance while unavoidably attacking the opposite contactable member and are therefore problematic in practical use.

SUMMARY OF THE INVENTION

It is an object of the present invention to provide an improved heat resistant and wear resistant iron-based sintered alloy which solves the problems encountered in conventional materials.

Another object of the present invention is to provide an improved heat resistant and wear resistant iron-based sintered alloy which is higher in resistance against high temperature oxidation and excellent in heat resistance while being prevented from wear during usage without damaging the opposite contactable member.

As a result of a variety of researches and experiments conducted by the inventors in view of the above, the inventors have developed dispersion-particle containing as major components Fe, Mo and Si (silicon), and discovered that mixing a suitable amount of this dispersion-particle with the powder of the matrix greatly improves the sintered alloy in heat resistance, corrosion resistance and wear resistance while suppressing the attacking ability against the opposite contactable member.

The heat resistant and wear resistant iron-based sintered alloy according to the present invention is comprised of a matrix formed of metal powders having the composition of alloy steel or high speed tool steel. An additional metal component is dispersed in the matrix and formed of hard alloy powder. The additional metal component is in an amount ranging from 3 to 50% by weight of the matrix. The hard alloy powder consists essentially of carbon in an amount ranging from 0.02 to 0.2% by weight, silicon in an amount ranging from 3 to 30% by weight, manganese in an amount ranging from 0.05 to 0.7% by weight, molybdenum in an amount ranging from 10 to 60% by weight, titanium in an amount ranging from 1 to 7% by weight, boron in an amount ranging from 0.5 to 2% by weight, nickel in an amount ranging from 1 to 10% by weight, and balance being iron and impurities.

The heat resistant and wear resistant iron-based sintered alloy is produced by compacting the metal powder of the matrix and the hard alloy powder of the additional metal component upon mixing and thereafter by sintering the compacted powders. By virture of iron, molybdenum and silicon contained in the hard alloy powder of the additional metal component, the hard alloy powder is higher in its wetting property with the powder of the matrix. Additionally such metal elements form intermetallic compounds which are high in hardness and excellent in heat resistance and oxidation resistance. Accordingly, the thus obtained iron-based sintered alloy is high in resistance against high temperature oxidation and excellent in heat resistance while being prevented from wear during usage without damaging the opposite contactable member. Accordingly, the iron-based sintered alloy exhibits an excellent performance particularly in case of being used for the material of engine component parts which are required to have high heat resistance and wear resistance at high temperatures. Thus, the iron-based sintered alloy is suitable for the material of a valve seat and a waste gate valve of a turbocharger in an internal combustion engine.

DETAILED DESCRIPTION OF THE INVENTION

According to the present invention, a heat resistant and wear resistant iron-based sintered alloy comprises a matrix formed of metal powder having the composition of alloy steel or high speed tool steel. An additional metal component is dispersed in the matrix and formed of hard alloy powder. The additional metal component is in an amount ranging from 3 to 50% by weight of the matrix. The hard alloy powder consists essentially of carbon (C) in an amount ranging from 0.02 to 0.2% by weight, silicon (Si) in an amount ranging from 3 to 30% by weight, manganese (Mn) in an amount ranging from 0.05 to 0.7% by weight, molybdenum (Mo) in an amount ranging from 10 to 60% by weight, titanium (Ti) in an amount ranging from 1 to 7% by weight, boron (B) in an amount ranging from 0.5 to 2% by weight, nickel (Ni) in an amount ranging from 1 to 10% by weight, and balance being iron (Fe) and impurities.

The iron-based sintered alloy is produced by mixing the metal powder of the matrix and the hard alloy powder of the additional metal component compacting the powders, and sintering the compacted powders. Optionally, the hard alloy powder of the additional metal component further consists essentially of at least one of niobium (Nb), tantalum (Ta) and tungsten (W) in an amount not more than 20% by weight. Further optionally, the hard alloy powder of the additional metal component consists essentially of at least one of chromium (Cr) and cobalt (Co) in an amount not more than 20% by weight.

The hard alloy powder of the additional metal component can be produced by atomization under the action of water jet, oil jet or gas jet. In this case, the particle size and/or the particle size distribution of the hard alloy powder is selectable to meet required characteristics. It will be understood the thus produced hard alloy powder can be dealt with in a process similar to a conventional powder metallurgy process. The hard alloy powder contains intermetallic compounds such as FeMoSi, $Fe_3MoSi$, $MoSi_2$ and the like which are high in hardness, heat resistance and oxidation resistance. In such intermetallic compounds, Mo may be substituted with Nb, Ta and/or W. The metal powder of the matrix is selectable from one having the structure of alloy steel or high speed tool steel, taking account of circumstance in which the resultant iron-based sintered alloy is used.

The content of the hard alloy powder of the additional metal component is 3 to 50% by weight relative to the metal powder of the matrix. If the content is less than 3% by weight, the effect of wear resistance at high temperatures are insufficient. If the content exceeds 50% by weight, the compactibility and sintering ability of the powders are deteriorated.

Reasons for defining the composition of the hard alloy powder of the additional metal component will be hereinafter discussed.

C:

C serves to prevent oxidation of the surface of powder particles as the material of the sintered alloy and is higher in speed of dispersion thereby becoming a source of liquid phase component during sintering. If the content of C is less than 0.02% by weight, such effects are insufficient. If the content is more than 0.2% by weight, carbide of Fe and Mo is unavoidably formed thereby preventing formation of the intermetallic compounds.

Si:

Si forms the intermetallic compounds such as FeMoSi, $Fe_3MoSi$ and $MoSi_2$, in combination with Fe and Mo thereby to provide wear resistance, heat resistance and oxidation resistance to the matrix while preventing oxidation of the surface of powder particles during formation of the powder particles. Additionally Si becomes the source of liquid phase component during sintering and improves the wetting property of the powder of the additional metal component with the metal powder of the matrix. If the content of Si is less than 3% by weight, the above-mentioned effect is insufficient. If the content exceeds 30% by weight, the melting point of the hard phase is lowered thereby deteriorating the characteristics of the hard phase during sintering.

Mn:

Mn exhibits deoxidation effect and desulfurization effect and serves to improve the wetting property of the metal powder of the additional metal component with the metal powder of the matrix. Such effects are insufficient if the content of Mn is less than 0.05% by weight. If the content exceeds 0.7% by weight, the hard alloy of the additional metal component becomes brittle.

Mo:

The content of Mo is necessary to be more than 10% by weight in order to form the intermetallic compounds in the powder particles of the additional metal component. If the content of Mo exceeds 60% by weight, the intermetallic compounds become unstable owing to balance of Si and Fe, thereby lowering the compactibility of the powder particles of the additional metal component together upon being mixed with the power particles of the matrix thus lowering the characteristics of the resultant sintered alloy.

Ti:

Ti forms a composite oxide film together with the intermetallic compounds such as FeMoSi, $Fe_3$-MoSi and $MoSi_2$ in oxidation atmosphere, upon being contained in such intermetallic compounds. The composite oxide film serves as a protecting film thereby providing heat resistance to the resultant sintered alloy. Such effects are insufficient if the content of Ti is less than 1% by weight, if the content of Ti exceeds 7% by weight, the hard alloy of the additional metal component becomes brittle.

B:

B serves to prevent oxidation of the surface of the power particles of the additional metal component and improves the wetting property of the alloy powder of the additional metal component with the metal powder of the matrix similarly to Si. Additionally, B serves to improve the stability of the intermetallic compounds. Such effects are insufficient if the content of B is less than 0.5% by weight. If the content exceeds 2% by weight, the hard alloy powder particles of the additional metal component becomes brittle.

Ni:

Ni is substituted with a part of Fe to improve heat resistance of the hard alloy of the additional metal component to be dispersed in the matrix, which leads to improvements in high temperature wear resistance and oxidation resistance. Such effects are insufficient if the content of Ni is less than 1% by weight. If the content of Ni exceeds 10% by weight, formation of the intermetallic compounds is prevented while lowering the melting point of the hard phase. This allows the hard alloy powder to become solid solution in the matrix during sintering, thus omitting the effects of heat resistance and wear resistance.

Nb, Ta, W:

Nb, Ta, and W are substituted with Mo in the intermetallic compounds such as FeMoSi, $Fe_3NoSi$ and $MoSi_2$ thereby to stabilize the intermetallic compounds and accordingly to improve heat resistance. Even if the content of at least one of Nb, Ta and W exceeds 20% by weight, a further improvement effect cannot be recognized and therefore using such a large amount of them is not economical.

Cr, Co:

Cr and Co serve to improve the heat resistance and the wear resistance of the hard alloy of the additional metal component thereby leading to improvement in high temperature wear resistance and oxidation resistance. The content of at least one of Cr and Co over 20% by weight is not recognized to offer a further improvement in the above effects and not economical.

The iron-based sintered alloy of the present invention is produced as follows: The hard alloy powder of the additional metal component is mixed with the metal powder of the matrix in an amount ranging from 3 to 50% by weight relative to the matrix metal usual powder. The thus mixed powders are compacted according to a usual powder metallurgy method and thereafter sintered. It is preferable that the sintering is made at a temperature ranging from 1100° to 1250° C. If the sintering temperature is below 1100° C., sintering is not sufficiently performed. If the sintering temperature exceeds 1250° C., the hard alloy powder becomes solid solution in the metal powder of the matrix. The structure (other than the hard phase) of the matrix may become pearlite, sorbite, martensite (including tempered martensite), and/or bainite, or a mixture of at least two of them under heat treatment.

In order to evaluate the heat resistant and wear resistant iron-based sintered alloy of the present invention, Examples 1 to 8 according to the present invention will be discussed hereinafter in comparison with Comparative Examples 1 to 6 which are not within the scope of the present invention.

EXAMPLES 1 to 4

Hard alloy powder (an additional metal component) was produced by an atomization method and had a composition consisting of 0.10 wt % C, 15.0 wt % Si, 0.3 wt % Mn, 50 wt % Mo, 4.0 wt % Ti, 1.5 wt % B, 7.0 wt % Ni, and balance being substantially Fe. Subsequently the thus produced hard alloy powder was blended with powder (a main metal component) of alloy steel having a particle size of −100 mesh in amounts of 3.0% by weight, 5.0% by weight, 10.0% by weight, and 50.0% by weight relative to the powder of the alloy steel thereby preparing four kinds of blended powders. The powder of the alloy steel had a composition consisting of 0.70 wt % C, 0.20 wt % Si, 0.1 wt % Mn, 0.1 wt % P, 5.0 wt % Cr, 2.0 wt % Mo, 1.0 wt % W, 1.0 wt % Co, and balance being substantially Fe. Then, higher fatty acid was added as lubricant to the blended powders, and they were sufficiently and homogeneously mixed. Thereafter, the blended powders were compacted into a predetermined shape and then sintered by being kept at 1180° C. for 1 hour under vacuum thus to produce sintered alloys. The sintered alloys were subjected to heat treatment to obtain sintered alloy products of Examples 1 to 4 as shown in Table 1.

COMPARATIVE EXAMPLES 1 TO 3

Hard alloy powder (an additional metal component) was produced by an atomization method and had a composition consisting of 0.10 wt % C, 15.0 wt % Si, 0.3 wt % Mn, 50 wt % Mo, 4.0 wt % Ti, 1.5 wt % B, 7.0 wt % Ni, and balance being substantially Fe. Subsequently the thus produced hard alloy powder was blended with powder of alloy steel having a particle size of −100 mesh in amounts of 0.5% by weight, 1.5% by weight, and 80.0% by weight relative to the powder (a main metal component) of the alloy steel thereby preparing three kinds of blended powders. The powder of the alloy steel had a composition consisting of 0.70 wt % C, 0.20 wt % Si, 0.1 wt % Mn, 0.1 wt % P, 5.0 wt % Cr, 2.0 wt % Mo, 1.0 wt % W, 1.0 wt % Co, and balance being substantially Fe. Then, higher fatty acid was added as lubricant to the blended powders, and they were sufficiently and homogeneously mixed. Thereafter, the blended powders were compacted into a predetermined shape and then sintered by being kept at 1180° C. for 1 hour under vacuum thus to produce sintered alloys. The sintered alloys were subjected to heat treatment to obtain sintered alloy products of Comparative Examples 1 to 3 as shown in Table 1.

EXAMPLES 5 TO 8

Hard alloy powder (an additional metal component) was produced by an atomization method and had a composition consisting of 0.15 wt % C, 5.0 wt % Si, 0.3 wt % Mn, 20 wt % Mo, 2.0 wt % Ti, 0.8 wt % B, 3.0 wt % Ni, 5.0 wt % Ta, 1.0 wt % W, and balance being substantially Fe. Subsequently the thus produced hard alloy powder was blended with powder (a main metal component) of alloy steel having a particle size of −100 mesh in amounts of 4.0% by weight, 10.0% by weight, 30.0% by weight, and 50.0% by weight relative to the powder of the alloy steel thereby preparing four kinds of blended powders. The powder of the alloy steel had a composition consisting of 0.50 wt % C, 0.15 wt % Si, 0.3 wt % Mn, 0.2 wt % P, 7.0 w % Cr, 5.0 wt % Mo, 3.0 wt % W, 3.0 wt % Co, and balance being substantially Fe. Then, higher fatty acid was added as lubricant to the blended powders, and they are sufficiently and homogeneously mixed. Thereafter, the blended powders were compacted into a predetermined shape and then sintered by being kept at 1200° C. for 1 hour under vacuum thus to produce sintered alloys. The sintered alloys were subjected to heat treatment to obtain sintered alloy products of Examples 5 to 8 as shown in Table 1.

COMPARATIVE EXAMPLES 4 TO 6

Hard alloy powder (an additional metal component) was produced by an atomization method and had a composition consisting of 0.15 wt % C, 5.0 wt % Si, 0.3 wt % Mn, 20 wt % Mo, 2.0 wt % Ti, 0.8 wt % B, 3.0 wt % Ni, 5.0 wt % Ta, 1.0 wt % W and balance being substantially Fe. Subsequently the thus produced hard alloy powder was blended with powder (a main metal component) of alloy steel having a particle size of −100 mesh in amounts of 0.3% by weight, 2.0% by weight, 75.0% by weight, and 50.0% by weight relative to the powder of the alloy steel thereby preparing four kinds of blended powders. The powder of the alloy steel had a composition consisting of 0.50 wt % C, 0.15 wt % Si, 0.3 wt % Mn, 0.2 wt % P, 7.0 wt % Cr, 5.0 wt % Mo, 3.0 wt % W, 3.0 wt % Co, and balance being substantially Fe. Then, higher fatty acid was added as lubricant to the blended powders and they were sufficiently and homogenously mixed. Thereafter, the blended powders were compacted into a predetermined shape and then sintered by being kept at 1200° C. for 1 hour under vacuum thus to produce sintered alloys. The sintered alloys were subjected to heat treatment to obtain sintered alloy products of Comparative Examples 4 to 6 as shown in Table 1.

TABLE 1

| Sample | | Composition: Main component (wt %) C | Si | Mn | P | Cr | Mo | W | Co | Additional metal component (wt %) C | Si | Mn | Mo | Ti | B | Ni | Ta | W |
|---|---|---|---|---|---|---|---|---|---|---|---|---|---|---|---|---|---|---|
| Example | 1 | 0.70 | 0.20 | 0.1 | 0.1 | 5.0 | 2.0 | 1.0 | 1.0 | 0.10 | 15.0 | 0.3 | 50 | 4.0 | 1.5 | 7.0 | — | — |
| | 2 | 0.70 | 0.20 | 0.1 | 0.1 | 5.0 | 2.0 | 1.0 | 1.0 | 0.10 | 15.0 | 0.3 | 50 | 4.0 | 1.5 | 7.0 | — | — |
| | 3 | 0.70 | 0.20 | 0.1 | 0.1 | 5.0 | 2.0 | 1.0 | 1.0 | 0.10 | 15.0 | 0.3 | 50 | 4.0 | 1.5 | 7.0 | — | — |
| | 4 | 0.70 | 0.20 | 0.1 | 0.1 | 5.0 | 2.0 | 1.0 | 1.0 | 0.10 | 15.0 | 0.3 | 50 | 4.0 | 1.5 | 7.0 | — | — |
| | 5 | 0.50 | 0.15 | 0.3 | 0.2 | 7.0 | 5.0 | 3.0 | 3.0 | 0.15 | 5.0 | 0.3 | 20 | 2.0 | 0.8 | 3.0 | 5.0 | 1.0 |
| | 6 | 0.50 | 0.15 | 0.3 | 0.2 | 7.0 | 5.0 | 3.0 | 3.0 | 0.15 | 5.0 | 0.3 | 20 | 2.0 | 0.8 | 3.0 | 5.0 | 1.0 |
| | 7 | 0.50 | 0.15 | 0.3 | 0.2 | 7.0 | 5.0 | 3.0 | 3.0 | 0.15 | 5.0 | 0.3 | 20 | 2.0 | 0.8 | 3.0 | 5.0 | 1.0 |
| | 8 | 0.50 | 0.15 | 0.3 | 0.2 | 7.0 | 5.0 | 3.0 | 3.0 | 0.15 | 5.0 | 0.3 | 20 | 2.0 | 0.8 | 3.0 | 5.0 | 1.0 |
| Comparative Example | 1 | 0.70 | 0.20 | 0.1 | 0.1 | 5.0 | 2.0 | 1.0 | 1.0 | 0.10 | 15.0 | 0.3 | 50 | 4.0 | 1.5 | 7.0 | — | — |
| | 2 | 0.70 | 0.20 | 0.1 | 0.1 | 5.0 | 2.0 | 1.0 | 1.0 | 0.10 | 15.0 | 0.3 | 50 | 4.0 | 1.5 | 7.0 | — | — |
| | 3 | 0.70 | 0.20 | 0.1 | 0.1 | 5.0 | 2.0 | 1.0 | 1.0 | 0.10 | 15.0 | 0.3 | 50 | 4.0 | 1.5 | 7.0 | — | — |
| | 4 | 0.50 | 0.15 | 0.3 | 0.2 | 7.0 | 5.0 | 3.0 | 3.0 | 0.15 | 5.0 | 0.3 | 20 | 2.0 | 0.8 | 3.0 | 5.0 | 1.0 |
| | 5 | 0.50 | 0.15 | 0.3 | 0.2 | 7.0 | 5.0 | 3.0 | 3.0 | 0.15 | 5.0 | 0.3 | 20 | 2.0 | 0.8 | 3.0 | 5.0 | 1.0 |
| | 6 | 0.50 | 0.15 | 0.3 | 0.2 | 7.0 | 5.0 | 3.0 | 3.0 | 0.15 | 5.0 | 0.3 | 20 | 2.0 | 0.8 | 3.0 | 5.0 | 1.0 |

| Sample | | Abrasion test result: Blended rate (wt %) of additional metal component | Abrasion depth (mm) of valve | Abrasion depth (mm) of valve seat | Appearance of valve seat |
|---|---|---|---|---|---|
| Example | 1 | 3.0 | 0.03 | 0.05 | No pitting (normal) |
| | 2 | 5.0 | 0.04 | 0.04 | No pitting (normal) |
| | 3 | 10.0 | 0.04 | 0.03 | No pitting (normal) |
| | 4 | 50.0 | 0.05 | 0.02 | No pitting (normal) |
| | 5 | 4.0 | 0.02 | 0.06 | No pitting (normal) |
| | 6 | 10.0 | 0.03 | 0.05 | No pitting (normal) |
| | 7 | 30.0 | 0.04 | 0.04 | No pitting (normal) |
| | 8 | 50.0 | 0.06 | 0.04 | No pitting (normal) |
| Comparative Example | 1 | 0.5 | 0.18 | 0.52 | No pitting |
| | 2 | 1.5 | 0.15 | 0.46 | " |
| | 3 | 80.0 | 0.52 | 0.05 | Excessive pitting, chipping found |
| | 4 | 0.3 | 0.12 | 0.73 | No pitting |
| | 5 | 2.0 | 0.21 | 0.51 | " |
| | 6 | 75.0 | 0.40 | 0.08 | Excessive pitting |

DURABLILITY TEST

Each of the resultant sintered alloy products of Examples 1 to 8 and the Comparative Examples 1 to 6 was machined into the shape of a valve seat of an engine valve for an internal combustion engine. An abrasion test was conducted on the thus machined alloy product by using a valve and valve seat tester simulating an actual engine. The tester was arranged such that a valve was operated to make opening and closing actions upon operation of an eccentric cam while rotating the valve by a valve rotator, under a condition in which the valve and the valve seat were heated upon combustion of liquefied petroleum gas while automatically regulating the temperatures of them. This test reproduced hammering abrasion of the valve and the valve seat and was conducted under the conditions shown in Table 2.

TABLE 2

| Item | Conditions |
|---|---|
| Atmosphere | Burnt liquified petroleum gas |
| Material of valve | Inconel 751 |
| Temperature of valve | 900° C. |
| Temperature of valve seat | 400° C. |
| Stroke | 6 mm |
| Operating time | 100 hrs |

After this test, the depth of abrasion of the valve and the valve seat (formed of the sintered alloy product of the Example or the Comparative Example) was measured to obtain the result shown in Table 1. Additionally, the appearance of the valve seat was observed to obtain the result shown also in Table 1.

As is apparent from the test results shown in Table 1, since the test was conducted at a high temperature and under a severe wear condition including rotation of the valve and a long test time, the valve seats formed of the sintered alloy products of the Comparative Examples 1 to 6 (not within the scope of the present invention) exhibited its excessive abrasion, providing an excessive abrasion against the valve as the opposite member. Further pitting was found in the valve seats. Thus, the valve seats formed of the sintered alloys not within the scope of the present invention did not exhibit good performance.

In contrast, the valve seats formed of the sintered alloy products of Examples 1 to 8 (according to the present invention) were less in abrasion while maintaining less abrasion of the valve as the opposite member. Thus, the valve seats formed of the sintered alloys according to the present invention exhibited high performance such as excellent heat resistance and wear resistance.

What is claimed is:

1. A heat resistant and wear resistant iron-based sintered alloy comprising:

a matrix formed of metal powder having composition of one selected from the group consisting of alloy steel and high speed tool steel; and an additional metal component dispersed in said matrix and formed of hard alloy powder, said additional metal component being in an amount ranging from 3 to 50% by weight of said matrix, said hard alloy powder consisting essentially of carbon in an amount ranging from 0.02 to 0.2% by weight, silicon in an amount ranging from 3 to 30% by weight, manganese in an amount ranging from 0.05 to 0.7% by weight, molybdenum in an amount ranging from 10 to 60% by weight, titanium in an amount ranging from 1 to 7% by weight, boron in an amount ranging from 0.5 to 2% by weight, nickel in an amount ranging from 1 to 10% by weight, and balance being iron and impurities.

2. A heat resistant and wear resistant iron-based sintered alloy as claimed in claim 1, wherein said iron-based sintered alloy is produced by mixing said metal power and said hard alloy powder, compacting the mixed powders, and sintering said compacted powders.

3. A heat resistant and wear resistant iron-based sintered alloy as claimed in claim 1, wherein said hard alloy powder consists essentially of at least one of niobium, tantalum and tungsten in an amount not more than 20% by weight.

4. A heat resistant and wear resistant iron-based sintered alloy as claimed in claim 1, wherein said hard alloy powder consists essentially of at least one of chromium and cobalt in an amount not more than 20% by weight.

5. A heat resistant and wear resistant iron-based sintered alloy as claimed in claim 1, wherein said hard alloy powder has intermetallic compound.

6. A heat resistant and wear resistant iron-based sintered alloy as claimed in claim 5, wherein said intermetallic compound is at least one selected from the group consisting of FeMoSi, $Fe_3MoSi$ and $MoSi_2$.

7. A heat resistant and wear resistant iron-based sintered alloy as claimed in claim 1, wherein said metal powder of said matrix has at least one structure of the group consisting of pearlite, sorbite, martensite, and bainite.

8. A heat resistant and wear resistant iron-based sintered alloy as claimed in claim 1, wherein said hard alloy powder contains at least 2% by weight titanium.

9. A heat resistant and wear resistant iron-based sintered alloy as claimed in claim 1, wherein said hard alloy powder contains from 2 to 4% by weight titanium.

10. A heat resistant and wear resistant iron-based sintered alloy as claimed in claim 1, wherein said hard alloy powder contains from 0.1 to 0.15% by weight carbon.

11. A heat resistant and wear resistant iron-based sintered alloy as claimed in claim 1, wherein said hard alloy powder contains from 5 to 15% by weight silicon.

12. A heat resistant and wear resistant iron-based sintered alloy as claimed in claim 1, wherein said hard alloy powder contains from 20 to 50% by weight molybdenum.

13. A heat resistant and wear resistant iron-based sintered alloy as claimed in claim 1, wherein said hard alloy powder contains from 0.8 to 1.5% by weight boron.

14. A heat resistant and wear resistant iron-based sintered alloy as claimed in claim 1, wherein said hard alloy powder contains from 3 to 7% by weight boron.

15. A heat resistant and wear resistant iron-based sintered alloy as claimed in claim 1, consisting essentially of said matrix and said additional metal component dispersed in said matrix.

16. A component part of an internal combustion engine which part is subjected to impact and friction at high temperatures, said component part being formed of a heat resistant and wear resistant iron-based sintered alloy which comprises:

a matrix formed of metal powder having composition of one selected from the group consisting of alloy steel and high speed tool steel; and an additional metal component dispersed in said matrix and formed of hard alloy powder, said additional metal component being in an amount ranging from 3 to 50% by weight of said matrix, said hard alloy powder consisting essentially of carbon in an amount ranging from 0.02 to 0.2% by weight, silicon in an amount ranging from 3 to 30% by weight, manganese in an amount ranging from 0.05 to 0.7% by weight, molybdenum in an amount ranging from 10 to 60% by weight, titanium in an amount ranging from 1 to 7% by weight, boron in an amount ranging from 0.5 to 2% by weight, nickel in an amount ranging from 1 to 10% by weight, and balance being iron and impurities.

17. A component part as claimed in claim 16, wherein said hard alloy powder contains at least 2% by weight titanium.

18. A valve seat of an engine valve for an internal combustion engine, said valve seat being formed of a heat resistant and wear resistant iron-based sintered alloy which comprises: a matrix formed of metal powder having composition of one selected from the group consisting of alloy steel and high speed tool steel; and an additional metal component dispersed in said matrix and formed of hard alloy powder, said additional metal component being in an amount ranging from 3 to 50% by weight of said matrix, said hard alloy powder consisting essentially of carbon in an amount ranging from 0.02 to 0.2% by weight, silicon in an amount ranging from 3 to 30% by weight, manganese in an amount ranging from 0.05 to 0.7% by weight, molybdenum in an amount ranging from 10 to 60% by weight, titanium in an amount ranging from 1 to 7% by weight, boron in an amount ranging from 0.5 to 2% by weight, nickel in an amount ranging from 1 to 10% by weight, and balance being iron and impurities.

19. A valve seat as claimed in claim 18, wherein said hard alloy powder contains at least 2% by weight titanium.

* * * * *